US005575575A

United States Patent [19]

Ide et al.

[11] Patent Number: 5,575,575

[45] Date of Patent: Nov. 19, 1996

[54] SMALL-SIZED PRINTER HAVING MULTIPLE FUNCTION MOTOR

[75] Inventors: Takehiko Ide, Tosu; Hiroki Kokubu, Kurume; Takahisa Shiramizu, Saga-ken; Yuji Tanaka, Chikushino; Tetsuo Hayama, Ogoori; Takashi Takeda, Tosu; Hiroyuki Fukusako, Tosu; Keisuke Shiba, Tosu; Akihiro Nishiyama, Kurume; Norio Amamoto, Tosu; Hidehito Nakamura, Kurume; Tsutomu Egashira, Saga-ken; Kouji Okada, Kurume, all of Japan

[73] Assignee: Matsushita Electric Industrial Co., Ltd., Osaka, Japan

[21] Appl. No.: 405,393

[22] Filed: Mar. 15, 1995

Related U.S. Application Data

[63] Continuation of Ser. No. 159,204, Nov. 30, 1993, abandoned.

[30] Foreign Application Priority Data

| | | | |
|---|---|---|---|
| Dec. 25, 1992 | [JP] | Japan | 4-346152 |
| Dec. 25, 1992 | [JP] | Japan | 4-346153 |
| Feb. 9, 1993 | [JP] | Japan | 5-021002 |
| Feb. 12, 1993 | [JP] | Japan | 5-023914 |

[51] Int. Cl.[6] ..... B41J 23/02

[52] U.S. Cl. ..... 400/185; 400/82; 400/149; 400/320; 400/656

[58] Field of Search ..... 400/88, 82, 656, 400/633, 149, 185, 320

[56] References Cited

U.S. PATENT DOCUMENTS

| | | | |
|---|---|---|---|
| 4,484,825 | 11/1984 | Wilczewski et al. | 400/185 |
| 4,572,685 | 2/1986 | Matsumoto et al. | 400/320 |
| 4,632,577 | 12/1986 | Brull et al. | 400/58 |
| 4,635,219 | 1/1987 | Howard | 400/88 |
| 4,676,682 | 6/1987 | Schacht | 400/633 |
| 4,761,663 | 8/1988 | Piatt et al. | 400/82 |
| 4,898,488 | 2/1990 | Yokoi et al. | 400/633 |
| 4,984,917 | 1/1991 | Hauslaib et al. | 400/656 |
| 5,188,464 | 2/1993 | Aaron | 400/88 |
| 5,402,109 | 3/1995 | Tatsumi et al. | 400/230 |
| 5,412,407 | 5/1995 | Okubo et al. | 400/320 |

FOREIGN PATENT DOCUMENTS

| | | | |
|---|---|---|---|
| 55-47425B2 | 11/1980 | Japan . | |
| 0041986 | 3/1982 | Japan | 400/88 |
| 59-144976 | 8/1984 | Japan . | |
| 62-234959 | 10/1987 | Japan . | |
| 4-158074 | 6/1992 | Japan | 400/88 |
| 2037665 | 7/1980 | United Kingdom | 400/88 |

*Primary Examiner*—John S. Hilten

*Attorney, Agent, or Firm*—Watson Cole Stevens Davis, P.L.L.C.

[57] ABSTRACT

A small-sized printer includes a printing section equipped with a shuttle head in which impact-type printing units are arranged in juxtaposition in a sub-scanning direction, a cylindrical cam for reciprocating the shuttle head in the sub-scanning direction, and paper feeding rollers for feeding a standard sheet in a main scanning direction; an input device for inputting information; a display device for displaying information; a RAM for storing information; and a CPU for controlling the printing section, the input section, the display device and the RAM and performing calculation on information. The printing section and the paper feeding rollers are provided in a body case in such a way as to be exposed where they are opposed to a case cover, which has a flat platen and spring members at positions opposed to the printing section, and ribs adapted to come into contact with the standard sheet and serving as a positioning device and as a sliding guide. The printing section provided in the body case has protrusions adapted to abut against the surface of the flat platen on the case cover. Spring members are provided to resiliently bias the flat platen against the protrusions, with a space being secured behind the flat platen.

26 Claims, 11 Drawing Sheets

SMALL-SIZED PRINTER HAVING MULTIPLE FUNCTION MOTOR

This application is a continuation of application Ser. No. 08/159,204, filed Nov. 30, 1993 (abandoned).

BACKGROUND OF THE INVENTION

The present invention relates to a small-sized portable printer for performing printing on checks or the like.

In some conventional small-sized printers, such as printers for checks, the printing section consists of a thermal transfer printer, as disclosed in Japanese Patent Unexamined Publication No. 62-234959. The application of such conventional printers for checks has been restricted to printing on checks and bank account balance statements.

Checks are used in commercial transactions, where simplicity and speed are essential. Thus, the user of the check cannot always be expected to handle it carefully, and in many cases the check is creased and wrinkled through rough handling. Accordingly the check is rarely in an ideal condition when it enters the printing section where printing is to be performed.

In the case of a conventional check printer whose printing section consists of a thermal transfer printer, such creases and wrinkles are a problem, since they will lead to inadequate contact between the printer and the check, resulting in defective printing, which is not acceptable, since it may cause trouble in the future.

Further, conventional check printers have the function of comparing the initially input amount with the amount issued and printing and displaying them. In actual commercial transactions, however, the mode of transaction varies. For example, payment can be made by cash, cards, etc. Thus, conventional check printers are incapable of adapting themselves to such varied transaction modes, which is very inconvenient for the user.

A small-sized printer is known which performs printing on rolled paper or standard sheets by means of a shuttle head. This type of small-sized printer will be described below.

FIG. 8 is a plan view of the essential part of the printing section of a small-sized printer of the above-mentioned type. Numeral 1' indicates a printing ribbon cassette, and numeral 2' indicates a printing ribbon drawn out of the printing ribbon cassette 1'. Numeral 3' indicates a shuttle head having a hammer 4', at one end of which a pin 5' is provided. Numeral 6' indicates the axle of the hammer 4'; numeral 7' indicates a magnetic pole; numeral 8' indicates a bobbin; numeral 9' indicates a return spring; and numeral 10' indicates a coil. Numeral 11' indicates a head, and numerals 12' and 13' indicate shafts extending through the head 11'. The head 11' is driven by a drive source (not shown) to reciprocate along the longitudinal length of the shafts 12' and 13'. Numeral 14' indicates a paper feeding roller, and numeral 15' indicates an auxiliary roller which is held in elastic contact with the paper feeding roller 14' by a spring 16'. Numeral 17' indicates a standard sheet. Numeral 18' indicates a cabinet; numeral 19' indicates a paper inlet; numeral 20' indicates a paper outlet; and numeral 21' indicates a platen. In this conventional small-sized printer, the mounting positions of the shafts 12' and 13' and the head gap between the pin 5' and the platen 21' have been adjusted, thereby securing a fixed level of printing quality.

The operation of the above-described small-sized printer will now be described.

First, the standard sheet 17' is inserted through the paper inlet 19', and stopped where it abuts the paper feeding roller 14'. In this condition the paper feeding roller 14' is rotated, and the standard sheet 17' reaches the position where printing should be performed.

Next, when performing printing, electric current is applied to the coil 10' to operate the magnetic pole 7', which pushes the hammer 4', thereby causing the pin 5' to operate using the axle 6' as the fulcrum. The pin 5' is pressed against the printing ribbon 2' so as to transfer the ink, with which the printing ribbon 2' is imbued, onto the standard sheet 17'. When the supply of electric current is stopped, the hammer 4' is returned to its initial position by the return spring 9'.

The small-sized printer of the above-described type has a problem in that the paper feeding roller 14' has to be rotated by the drive source when inserting the definite-form sheet 17', which makes the setting rather difficult. To facilitate the insertion, a releasing mechanism for the auxiliary roller 15' might be provided, which, however, would result in a complicated structure and high costs. Further, since the width of the paper inlet 19' must be adapted to the maximum dimension of the prescribed sheet size, the sheet cannot be perfectly positioned along the lateral dimension thereof. Also, positioning along the paper feeding dimension cannot be effected correctly. Thus, in the case of a sheet such as a check, in which the printing position has been determined beforehand, displacement of the printing position or skewing may occur. Further, in the above-described small-sized printer, the head gap adjustment requires a great deal of skill and time. In this regard, a function might be provided by which the pressure applied to the pin 5' is measured for automatic adjustment, which, however, would involve a complicated structure and high cost.

In recent years, there is a demand for a reduction in printing time in small-sized printers. In this regard, an increase in printing speed has been attained by two-direction printing. To perform two-direction printing, it is necessary for the home position of the printing head to be detected with high accuracy so that the requisite stability in registration for printing may be ensured in both directions.

A conventional small-sized printer of this type will be described with reference to FIG. 16. Referring to the drawing, the conventional small-sized printer comprises a motor 301 for outputting driving force to different parts of the printer; a gear 302 connected with the driving shaft of the motor 301; a cylindrical cam 303 connected with the gear 302 and having a meandering guide groove 330 on its surface; a printing head 304 which moves in engagement with the guide groove 330 to effect printing in a fixed area of a sheet; a home detecting means 305 for detecting the home position of the printing head 304; a shutter 306 attached to the printing head 304; an encoder 311 connected with the motor 301 and having holes arranged at fixed intervals; a pulse generating means 308 for generating pulses by means of the encoder 311; a calculating means 390 for calculating the home position of the printing head 304 on the basis of signals from the home detecting means 305 and the pulse generating means 308; and a driving means 310 for driving the motor 301 in accordance with the calculation results to move the printing head 304 to the home position.

The operation of this conventional small-sized printer, constructed as descried above, will now be explained.

First, the cylindrical cam 303 is rotated by the motor 301 through the gear 302. The printing head 304, which has a protrusion 340 engaged with the guide groove 330 of the cylindrical cam 303, moves to the right and left to perform printing. When the printing head 304 has been moved to the home position, the shutter 306 attached to the printing head 304 intercepts the home detecting means 305 consisting of a transmission-type optical sensor, thereby generating a home detection signal. The pulse generating means 308 generates pulses at fixed intervals (FIG. 18A) in synchronism with the rotation of the motor 301, to which the encoder 311 comprising a disk 370 as shown in FIG. 17 is attached, and the calculation means 390 performs a calculation on the home detection signal and the pulse signals, whereby the home position of the printing head 304 is determined. Then, printing is started from the home position while counting the pulses generated. By this arrangement, it is always possible to start printing at a position spaced apart from the home position by a fixed distance, thereby ensuring the requisite stability for printing in one direction.

However, although the above-described conventional construction makes it possible to effect correct registration in one-direction printing, it has the following problem: In two-direction printing, it involves generation of a positional deviation between the printing head 304 and the encoder 311 due to the backlash of the cylindrical cam and the gear. Thus, as shown in FIG. 18A, assuming that the first pulse of the home detection signal corresponds to the home position, such a positional deviation leads to a pulse gap, resulting in the home position being displaced by one pulse. As a result, as shown in FIG. 18B, a positional deviation is generated in the printing performed in direction 2, resulting in the printed characters being deformed. In view of this, it is necessary for the encoder 311 and the pulse generating means 308 to be of high precision, and for the gear to exhibit no backlash. Thus, ideal two-direction printing is difficult to realize.

SUMMARY OF THE INVENTION

It is an object of the present invention to provide a small-sized printer which can obtain clear printing results irrespective of the condition of the standard sheet and flexibly cope with various situations in commercial transactions.

Another object of the present invention is to provide a small-sized printer which can realize easy paper setting and reliable paper feeding without skewing.

Still another object of the present invention is to provide a small-sized printer which allows head gap adjustment to be easily performed.

To achieve the above objects, there is provided, in accordance with the present invention, a small-sized printer of the type which includes a body case having a portable size and which is adapted to perform printing on a printing medium having a width not larger than that of the body case, the small-sized printer comprising medium feeding means for feeding the printing medium parallel to the longer side dimension of the body case and in a main scanning direction which is parallel to the longer side dimension of the printing medium; printing drive means for reciprocating a printing means along the width dimension of the body case and in a sub-scanning direction which is parallel to the shorter side dimension of the printing medium; and printing means engaged with the printing drive means and comprising a plurality of impact-type printing units arranged in juxtaposition in the sub-scanning direction.

In one aspect of the present invention, there is provided a small-sized printer of the type which includes a body case having a portable size and which is adapted to perform printing on a printing medium having a width not larger than that of the body case, the small-sized printer comprising a case cover mounted on the body case in such a way that it can be opened and closed; medium feeding means for feeding the printing medium parallel to the longer side dimension of the body case and in a main scanning direction which is parallel to the longer side dimension of the printing medium; printing drive means for reciprocating a printing means along the width dimension of the body case and in a sub-scanning direction which is parallel to the shorter side dimension of the printing medium; printing means engaged with the printing drive means and comprising a plurality of impact-type printing units arranged in juxtaposition in the sub-scanning direction; and a flat platen provided on that surface of the case cover which is opposed to the printing means when the case cover is closed on the body case.

In another aspect of the present invention, there is provided a small-sized printer of the type which includes a body case having a portable size and which is adapted to perform printing on a printing medium having a width not larger than that of the body case, the small-sized printer comprising a case cover mounted on the body case in such a way that it can be opened and closed; medium feeding means for feeding the printing medium parallel to the longer side dimension of the body case and in a main scanning direction which is parallel to the longer side dimension of the printing medium; printing drive means for reciprocating a printing means along the width dimension of the body case and in a sub-scanning direction which is parallel to the shorter side dimension of the printing medium; printing means engaged with the printing drive means and comprising a plurality of impact-type printing units arranged in juxtaposition in the sub-scanning direction; and a plurality of protruding members adapted to perform positioning of the printing medium and serving as a feeding guide, the protruding members being provided on that surface of the case cover opposed to the printing means when it is closed on the body case, and arranged in juxtaposition in a direction in which the printing medium is fed.

In still another aspect of the present invention, there is provided a small-sized printer of the type which includes a body case having a portable size and which is adapted to perform printing on a printing medium having a width not larger than that of the body case, the small-sized printer comprising a case cover mounted on the body case in such a way that it can be opened and closed; medium feeding means for feeding the printing medium parallel to the longer side dimension of the body case and in a main scanning direction which is parallel to the longer side dimension of the printing medium; printing drive means for reciprocating a printing means along the width dimension of the body case and in a sub-scanning direction which is parallel to the shorter side dimension of the printing medium; printing means engaged with the printing drive means and comprising a plurality of impact-type printing units arranged in juxtaposition in the sub-scanning direction; a flat platen provided on that surface of the case cover which is opposed to the printing means when it is closed on the body case; and a plurality of protruding members adapted to perform positioning of the printing medium and serving as a feeding guide, the protruding members being provided on that surface of the case cover which is opposed to the printing means when it is closed on the body case, and arranged in juxtaposition in a direction in which the printing medium is fed.

DESCRIPTION OF THE PREFERRED EMBODIMENTS

Figure 1A:
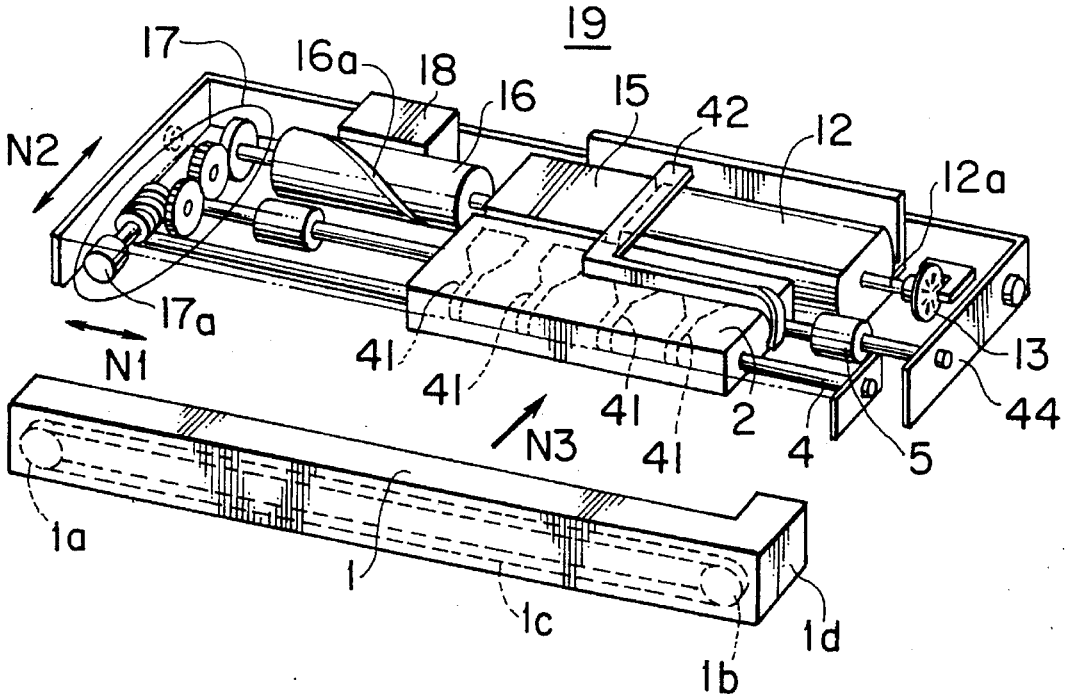
FIG. 1A is a perspective view of a printing section of a small-sized printer according to a first embodiment of the present invention.
Figure 1B:
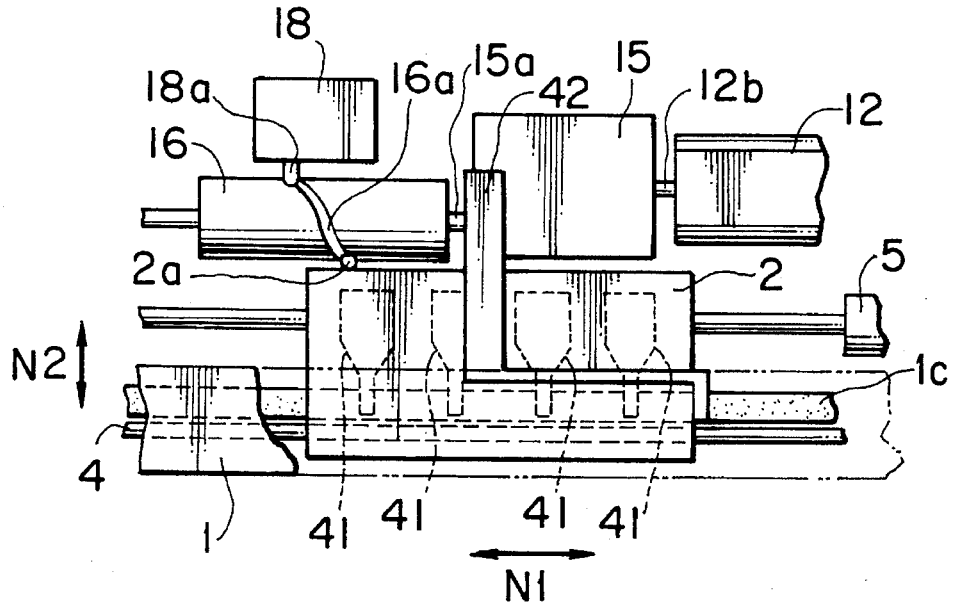
FIG. 1B is a plan view of part of the printing section of the small-sized printer of the first embodiment of the present invention.

FIGS. 1A is a perspective view of a printing section of a small-sized printer according to the first embodiment of the present invention, and FIG. 1B is a plan view of part of this printing section. Numeral 1 indicates a ribbon cassette; numeral 1*a* indicates a driving pulley rotatably supported at the left end (as seen in the drawing) of the ribbon cassette 1; and numeral 1*b* indicates a driven pulley rotatably supported at the right end of the ribbon cassette. An ink ribbon 1*c* is engaged with the driving pulley 1*a* and the driven pulley 1*b* so as to be replenished with ink from an ink fountain 1*d*. Numeral 44 indicates a printing section frame, and numeral 2 indicates a shuttle head, which contains impact-type printing units 41 arranged in parallel along a sub-scanning direction N1. The printing units 41 exert a printing action in a downward direction. The shuttle head 2 is supported by a shaft 4 extending therethrough, in such a way as to be slidable along the sub-scanning direction N1 within the printing section frame 44.

Numeral 5 indicates paper feeding rollers supported by the printing section frame 44 in such a way as to be rotatable around an axis extending along the sub-scanning direction N1. The paper feeding rollers 5 serve to feed a standard sheet, such as a check, in a main scanning direction N2. The torque of a motor 12 is transmitted to the paper feeding rollers 5. Numeral 13 indicates an encoder for detecting the rotation amount of one output shaft 12*a* of the motor 12, and numeral 15 indicates a gear box to which the other output shaft 12*b* of the motor 12 is connected, the two output shafts 12*a* and 12*b* of the motor 12 rotating in synchronism. Numeral 15*a* indicates an output shaft of the gear box 15, which output shaft is connected with a cylindrical cam 16. When the motor 12 is driven, its torque is decelerated by a row of gears inside the gear box before it is transmitted to the cylindrical cam 16. A spiral groove 16*a* is formed on the peripheral surface of the cylindrical cam 16. The spiral groove 16*a* is engaged with a protrusion 2*a* provided on the back surface of the shuttle head 2. The groove 16*a* is also engaged with an operating protrusion 18*a* of a balancer 18. Due to this engagement of the shuttle head 2 and the balancer 18 with the groove 16*a*, they move in opposite phases with respect to each other, thereby mitigating the vibration during operation.

Numeral 17 indicates a row of gears for transmitting the power of the cylindrical cam 16 to the driving pulley 1*a*, and numeral 17*a* indicates a ribbon driving shaft. Numeral 42 indicates a flat cable for supplying a driving signal to the shuttle head 2. When the ribbon cassette 1 is fitted into the printing section frame 44 as indicated by an arrow N3 in FIG. 1A, the ribbon driving shaft 17*a* engages with the driving pulley 1*a*, so that the torque of the motor 12 is transmitted to the driving pulley 1*a*, making it possible to feed the ribbon 1*c* in the sub-scanning direction N1. Further, in this condition, the printing units 41 strike the standard sheet 7 through the ink ribbon 1*c*, as shown in FIG. 1B, so that the ink of the ink ribbon 1*c* is transferred to the standard sheet 7, thereby effecting printing on the sheet. The above-described components altogether constitute a printing section 19.

Figure 2:
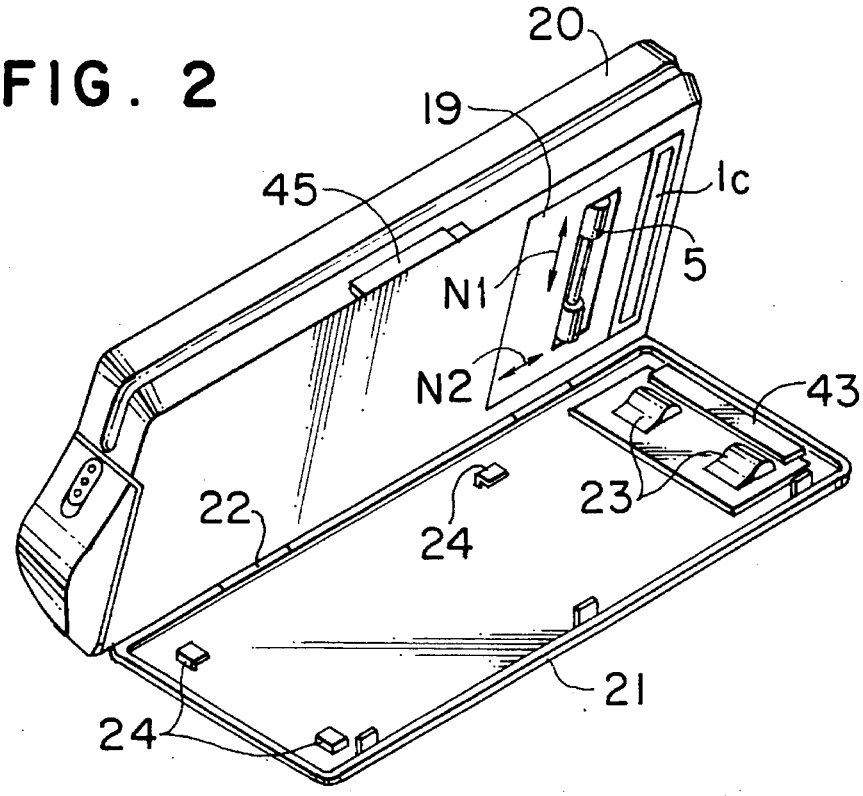
FIG. 2 is a perspective view of the printing section of the small-sized printer of the first embodiment of the present invention.

FIG. 2 is a perspective view showing the printing section 19 attached to a body case 20. Numeral 21 indicates a case cover, and numeral 22 indicates hinges for connecting the case cover 21 with the body case 20 in such a way that it can be opened and closed with respect to the body case. Numeral 43 indicates a flat platen provided on the case cover 21 at a position opposite to the ink ribbon 1*c*; numeral 23 indicates plate springs for biasing the check 7 toward the paper feeding rollers 5; numeral 24 indicates ribs protruding from the case cover 21; and numeral 45 indicates a cover opening/closing lever protruding from the body case 20 toward the case cover 21 and adapted to be detachably engaged with the case cover 21.

Figure 3:
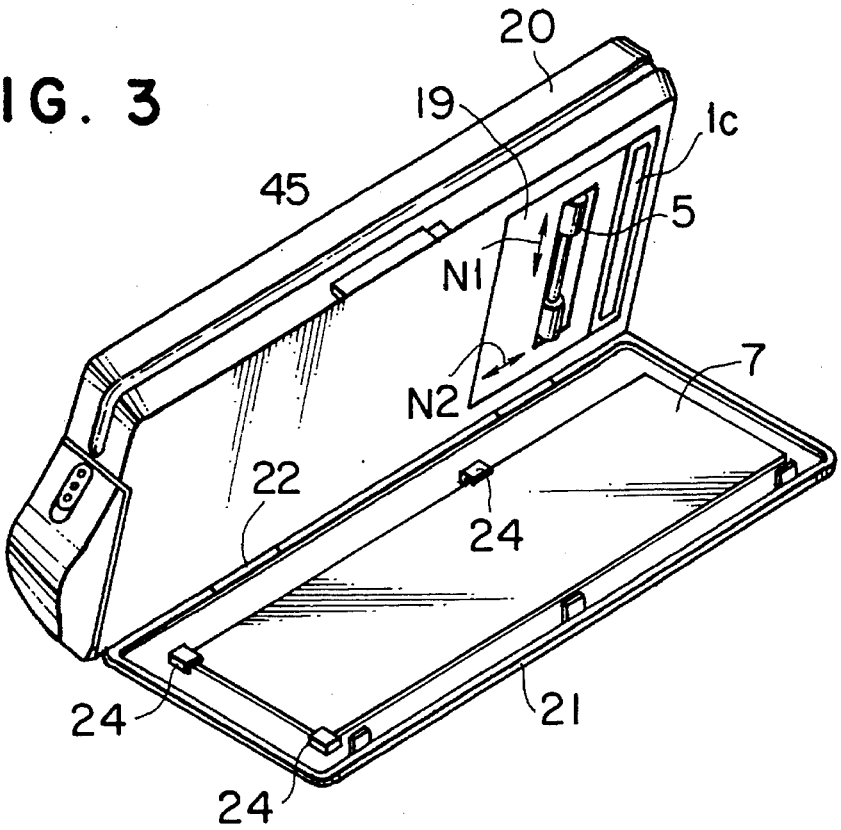
FIG. 3 is a perspective view of the small-sized printer of the first embodiment of the present invention with a standard sheet set therein.

As shown in the drawing, the printing section 19 is mounted in the inner front section of the body case 20. The flat platen 43 and the plate springs 23, which are provided on the case cover 21, are positioned in such a way as to be opposed to the printing section 19. The paper feeding rollers 5 are exposed in such a way that they can come into contact with the plate springs 23. The ink ribbon 1*c* is opposed to the flat platen 43. FIG. 3 is a perspective view of the small-sized printer loaded with the standard sheet 7. The ribs 24 serve as a means for positioning the standard sheet 7 on which printing is to be performed, and, at the same time, as sliding guides for the standard sheet. A plurality of these ribs 24 are arranged on the inner side of the case cover 21 along the feeding line for the standard sheet 7 so that they can come into contact with the side edges of the sheet 7 so as to position the same. The ribs 24 have a hook-shaped cross-sectional configuration so that they can firmly hold the side edge portions of the standard sheet 7 without allowing it to go astray.

Figure 4:
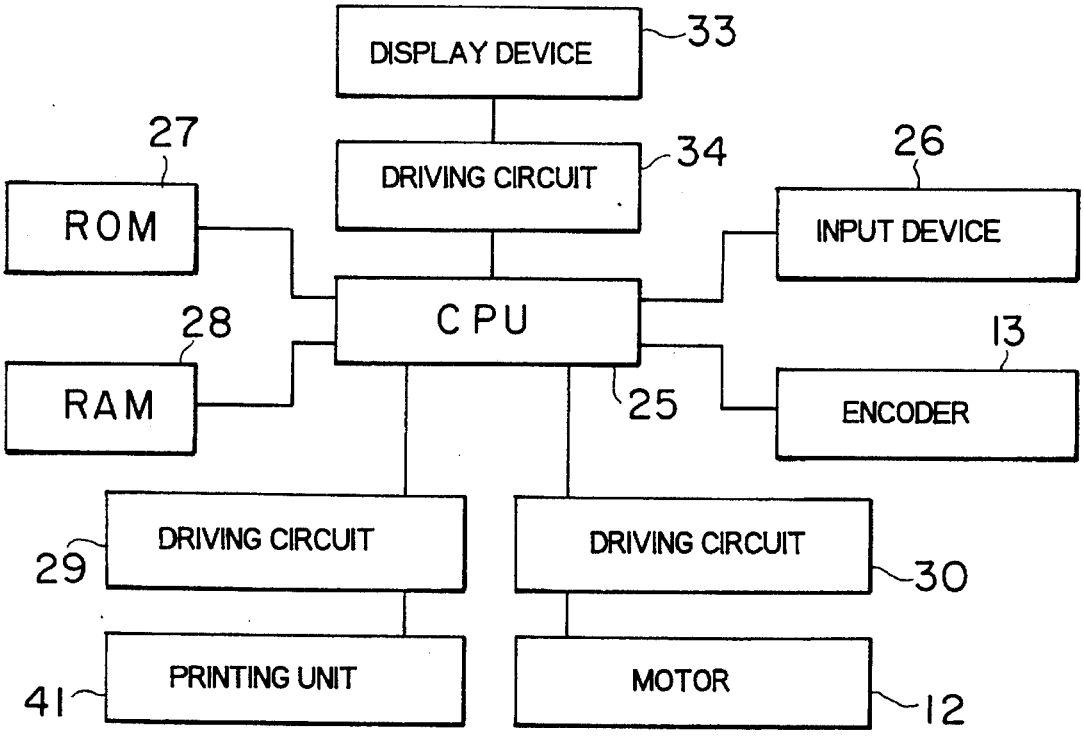
FIG. 4 is a block diagram of the small-sized printer of the first embodiment of the present invention.

FIG. 4 is a block diagram showing the small-sized printer of the first embodiment of the present invention. Numeral 25 indicates a CPU; numeral 26 indicates input devices for performing printing input or data input; numeral 27 indicates a ROM for storing programs and various kinds of information; numeral 28 indicates a RAM serving as a storage means for temporarily storing various kinds of information; numeral 29 indicates a driving circuit for driving the printing units 41 in the shuttle head 2; and numeral 30 indicates a driving circuit for driving the motor 12. The ROM 27, the CPU 25, the driving circuits 29 and 30, etc. constitute a control means.

Figure 5:
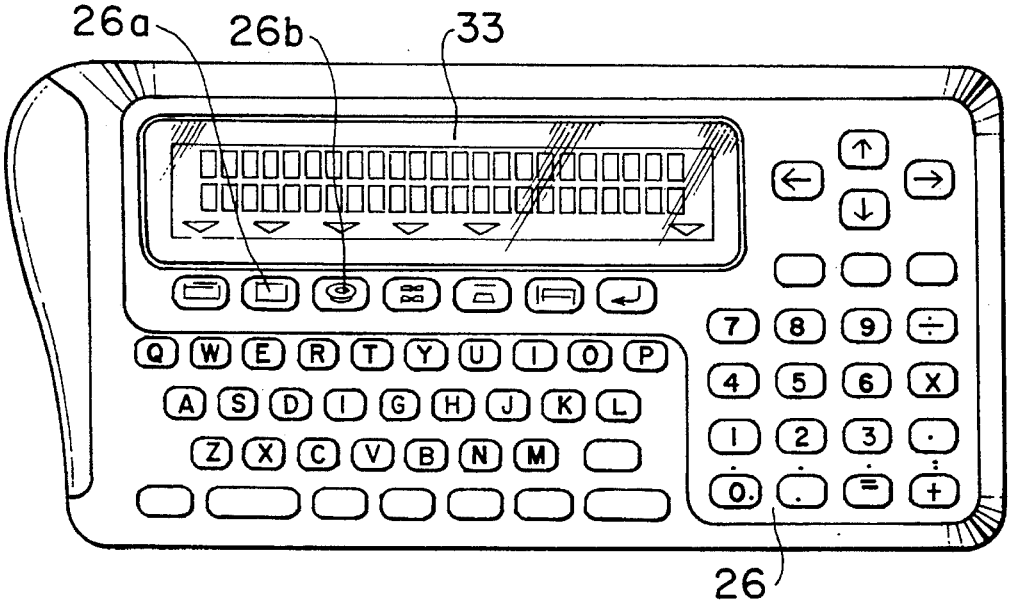
FIG. 5 is an outward view of the small-sized printer of the first embodiment of the present invention.

FIG. 5 shows an external appearance of a display device 33 of the small-sized printer of the first embodiment of the present invention together with the input devices 26 thereof. The input devices 26 include a card function key 26*a* for handling cards, and a cash function key 26*b* for handling cash. The display device consists of an LCD.

The operation of the small-sized printer of this embodiment, constructed as described above, will now be explained. First, when inserting the standard sheet 7, the cover opening/closing lever 45 is released to open the case cover 21, as shown in FIG. 2. Then, as shown in FIG. 3, the side edges of the standard sheet 7 are engaged with the ribs 24 for positioning. Next, the case cover 21 is closed, thereby causing the standard sheet 7 to be held between the ink ribbon 1*c* and the flat platen 43, with the plate springs 23 pressing the standard sheet 7 against the paper feeding rollers 5. Although not shown, the setting of rolled paper can be effected in the same way as in the case of a check, by putting the portion of the rolled paper on which printing is to be performed between the ribs 24.

Next, paper feeding and printing operations will be described. Information input through the input devices 26 is calculated by the CPU 25, and the rotation amount and rotating speed are determined on the basis of the data of the ROM 27 and RAM 28, whereby the driving circuit 30 causes the motor 12 to rotate. The power of the motor 12, transmitted through the row of gears (not shown) in the gear box 15, causes the cylindrical cam 16 to rotate. The shuttle head 2 and the balancer 18, which are engaged with the groove 16*a* on the cylindrical cam 16, reciprocate in the thrust directions in such a way as to be in opposite phases with respect to each other. The torque of the motor 12 is further transmitted through the row of gears 17 to rotate the paper feeding rollers 5 and the ribbon driving shaft 17*a*, with the result that the driving pulley 1*a* rotates to take up the ink ribbon 1*c* engaged with the driving pulley 1*a*. The standard sheet 7, which is biased by the plate springs 23, is fed by the rotation of the paper feeding rollers 5. When performing printing, the CPU 25 refers to the rotation amount detected by the encoder 13, and, with a fixed timing, the printing units 41 in the shuttle head 2 are driven by the driving circuit 29, so that printing is effected on the standard sheet 7 by the ink with which the ink ribbon 1*c* is imbued. Here, the printing is performed by the printing units 41, which are of the impact type, so that clear printing results can be obtained even when the standard sheet 7 has wrinkles or creases.

Next, the input, storage and display of data will be described. The information input through the input devices 26 is calculated by the CPU 25 for executing programs in the ROM 27 and is displayed on the display 33 by the driving circuit 34.

When the function key for handling cards is depressed, calculation is performed by the CPU 25 to compare the input amount with the amount initially input to the RAM 28. The comparison results are displayed on the display device 33, and the calculation results and hysteresis are stored in the RAM 28.

When the function key for handling cash is depressed, calculation is likewise performed by the CPU 25 to compare the input amount with the amount initially input to the RAM 28. The comparison results are displayed on the display device 33, and the calculation results and hysteresis are stored in the RAM 28.

In the second embodiment of the present invention, the shuttle head moves in the sub-scanning direction to effect printing by the impact-type printing units, so that clear printing results can be obtained even when the standard sheet has wrinkles and creases. Further, through the calculation of the control means, it is possible to cope with various modes of commercial transaction where cash or cards are used.

Figure 6:
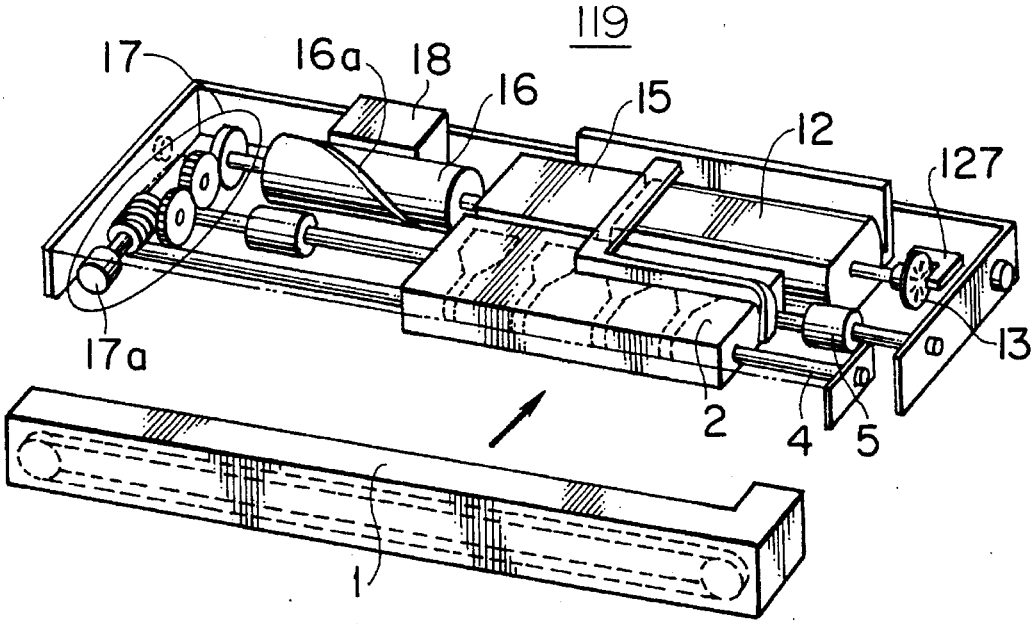
FIG. 6 is a perspective view of the printing section of a small-sized printer according to a second embodiment of the present invention.
Figure 7:
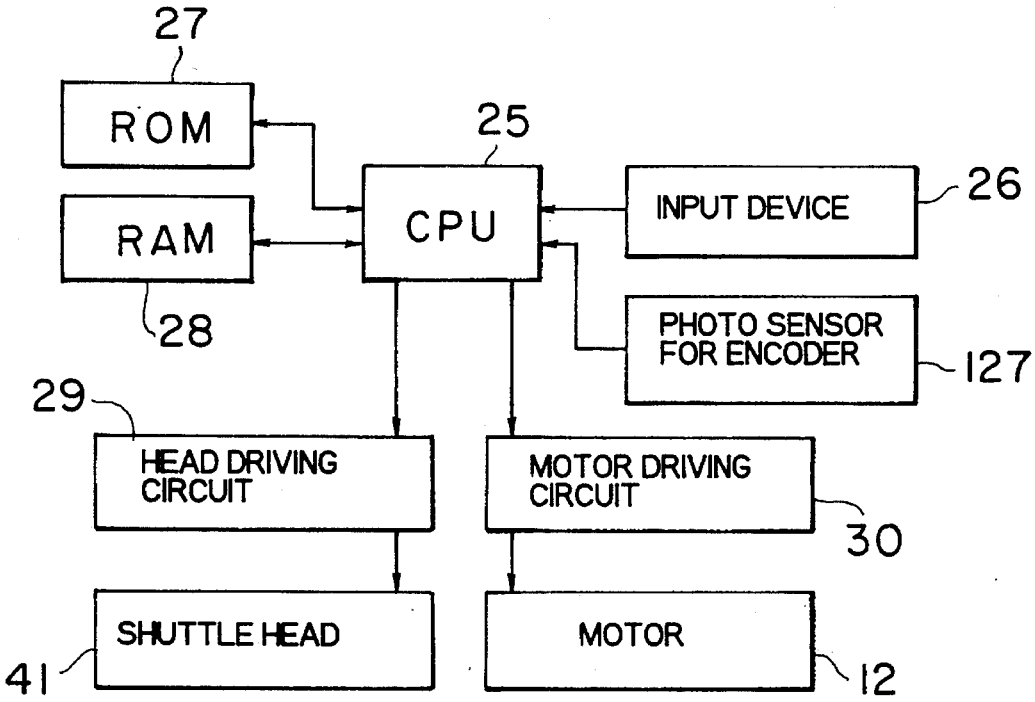
FIG. 7 is an electric-circuit block diagram of the small-sized printer of the second embodiment of the present invention.
Figure 8:
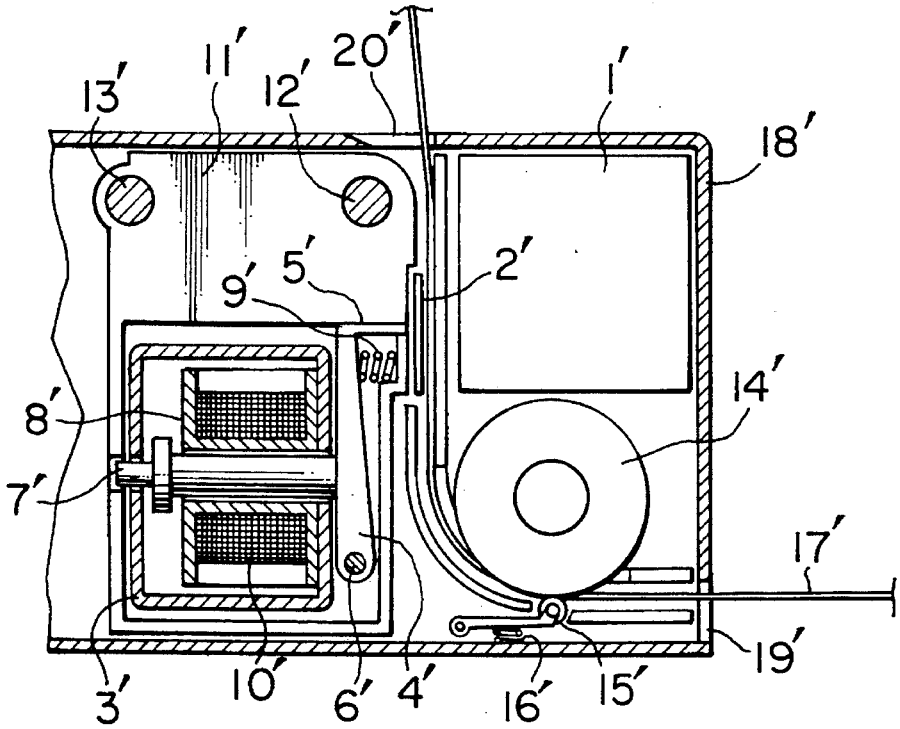
FIG. 8 PRIOR ART
FIG. 8 is a sectional view of the essential part of the printing section of a conventional small-sized printer.

FIG. 6 is a perspective view of a printing section 119 of a small-sized printer according to the second embodiment of the present invention. This printing section differs from the printing section 19 of the first embodiment in that it is equipped with a photo sensor 127.

In the paper feeding and printing operations, the check or standard sheet 7 is biased by the plate springs 23, so that it is fed while being kept in elastic contact with the paper feeding rollers 5. In this process, the standard sheet is guided in its sliding by the ribs 24 so that it is fed straight without going astray. When performing printing, the slits of the encoder 13 are read by the photo sensor 127, and the CPU 25 calculates the output of the photo sensor 127. The shuttle head 2 is driven with a fixed timing by the head driving circuit 29, and printing is performed on the standard sheet 7 with the ink with which the printing ribbon 1*c* is imbued.

In accordance with the second embodiment of the present invention, the object on which printing is to be performed can be set easily solely by opening the case cover. Further, defective printing due to skewing can be eliminated, so that it is possible to obtain a compact printer which is convenient for use.

Figure 9:
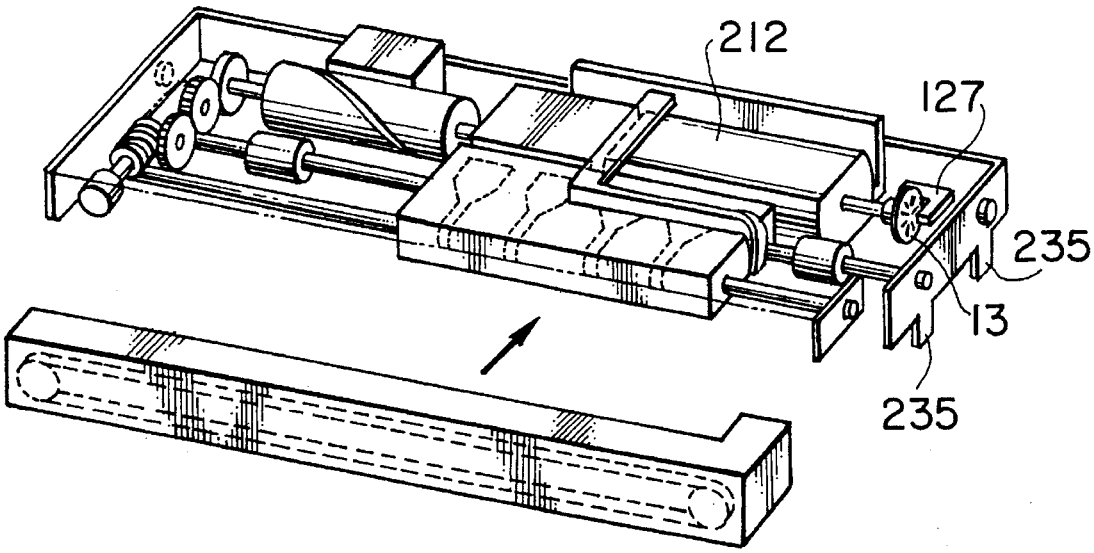
FIG. 9 is a perspective view of the printing section of a small-sized printer according to a third embodiment of the present invention.

FIG. 9 is a perspective view of a printing section of a small-sized printer according to the third embodiment of the present invention. In the following, the third embodiment will be described with regard to those portions thereof where it differs from the first and second embodiments. Referring to FIG. 9, numeral 13 indicates an encoder attached to one shaft of a DC motor 212, and numeral 127 indicates a sensor for the encoder.

Figure 10:
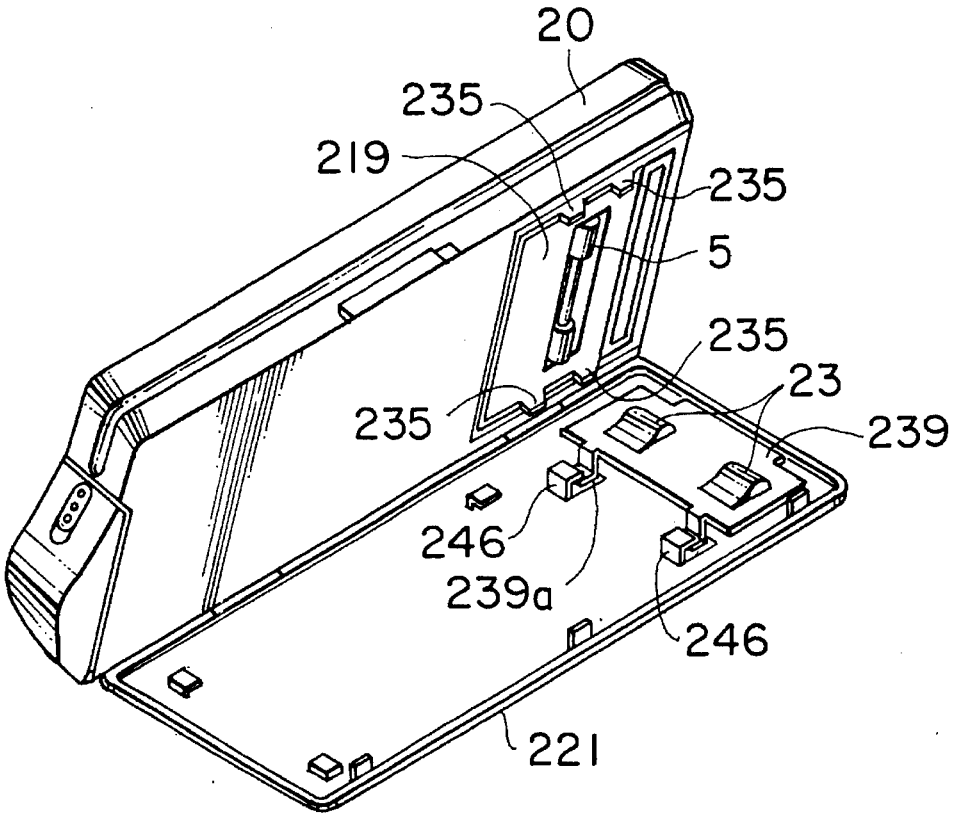
FIG. 10 is a perspective view of the small-sized printer of the third embodiment of the present invention.

FIG. 10 is a perspective view of the small-sized printer of the third embodiment whose printing section 219 is attached to the body case 20, with the cover being open. Numeral 235 indicates protrusions provided in the printing section 219, and numeral 239 indicates a flat platen.

Figure 11:
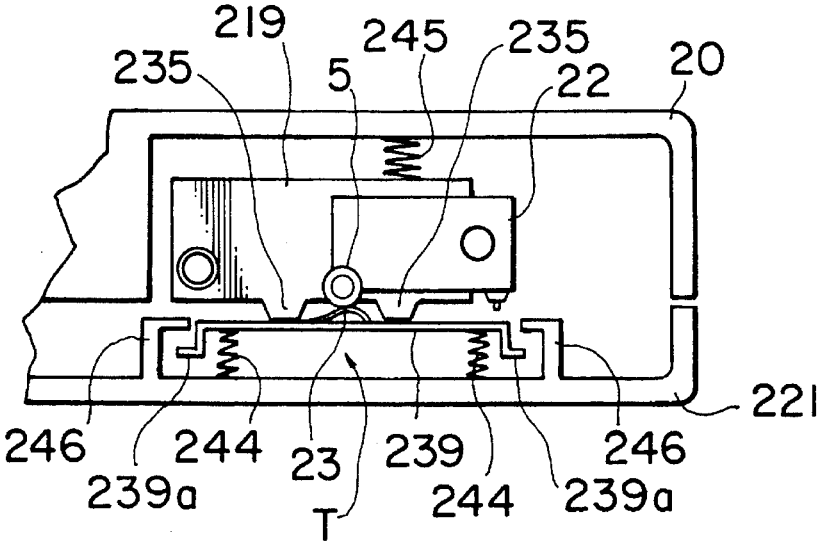
FIG. 11 is a sectional view of the small-sized printer of the third embodiment of the present invention.

FIG. 11 is a sectional view of the printer with its case cover 221 closed. Numeral 244 indicates spring members for elastically supporting the flat platen 239, whose side edge portions are formed as engagement sections 239*a* that are bent into a hook-like configuration. The engagement sections 239*a* are engaged with engagement claws 246 which are formed on the inner surface of the case cover by cutting and raising part of the bottom thereof. The flat platen 239 is prevented from coming off by the engagement sections 239*a* and the engagement claws 246. The flat platen 239 is biased toward the protrusions 235 by the spring members 244 provided on the back surface thereof, while the printing section 219 is elastically biased toward the flat platen 239 by a spring member 245 provided on its back surface. When the case cover 221 is closed, the tips of the protrusions 235 come into elastic contact with the surface of the flat platen 239 by the resilient force of the spring members 244 and 245, with a space T being secured behind the flat platen 239. Thus, the flat platen 239 can be constantly and securely held in contact with the protrusions 235. Accordingly, with a certain level of accuracy in the height of the protrusions 235, it is possible to obtain a fixed head gap without having to perform any adjustment. Further, due to the resilient force of the spring member 245, the case cover 221 can be easily opened. The flat platen 239 is formed of a damping steel, so that it is possible to mitigate the noise due to the reduction in thickness of the flat platen 239.

In accordance with the third embodiment, closing the case cover causes the protrusions of the printing section and the flat platen to come into contact with each other due to the resilient force of the spring members to secure the requisite head gap, so that, with a certain level of accuracy in the height of the protrusions, it is possible to obtain a fixed head gap without having to perform any adjustment, thereby making it possible to reduce the operation time and to obtain a stable printing quality. Further, since the flat platen is formed of a damping steel plate, the noise due to the reduction in the thickness of the flat platen can be mitigated. In addition, due to the resilient force of the spring members, the case cover can be easily opened.

Figure 12:
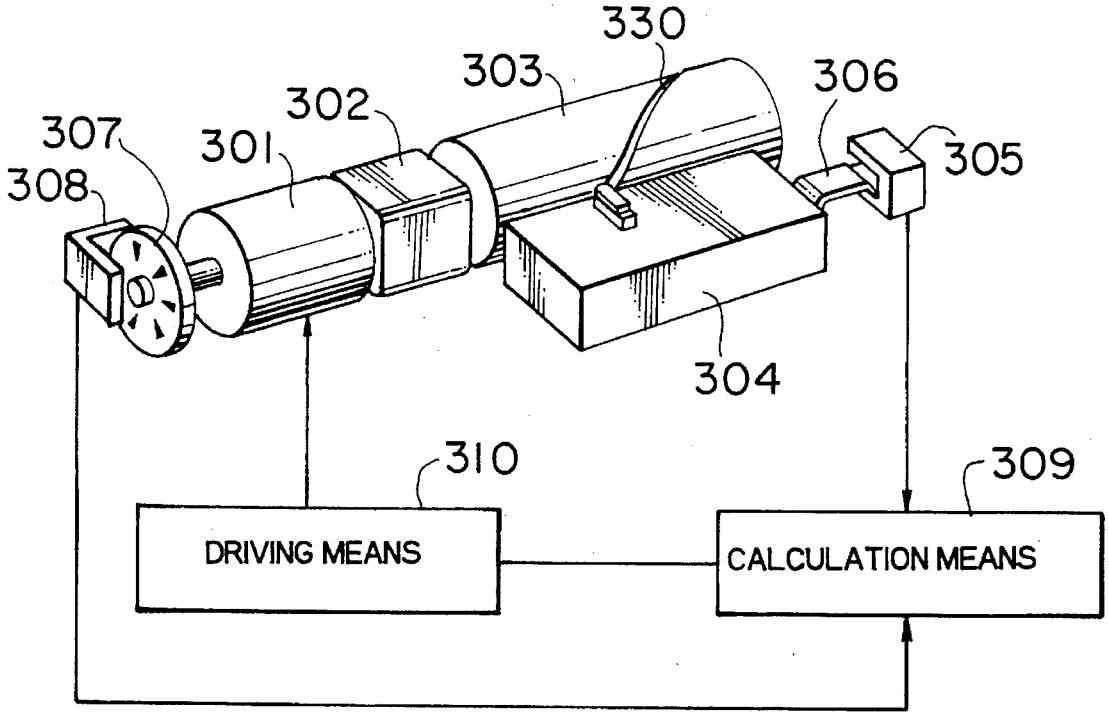
FIG. 12 is a schematic view of a small-sized printer according to a fourth embodiment of the present invention.
Figure 13:
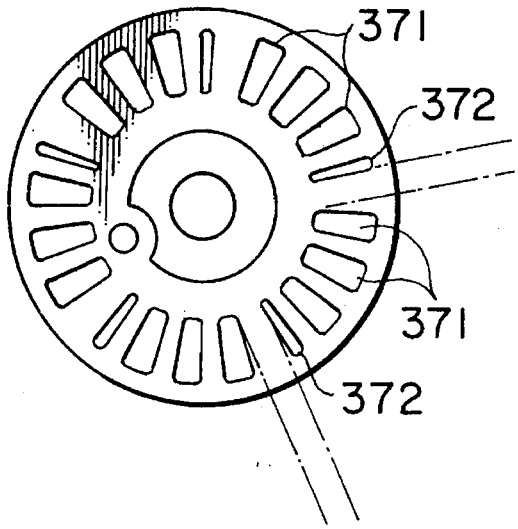
FIG. 13 is a plan view of an encoder in the fourth embodiment of the present invention.
Figure 14:
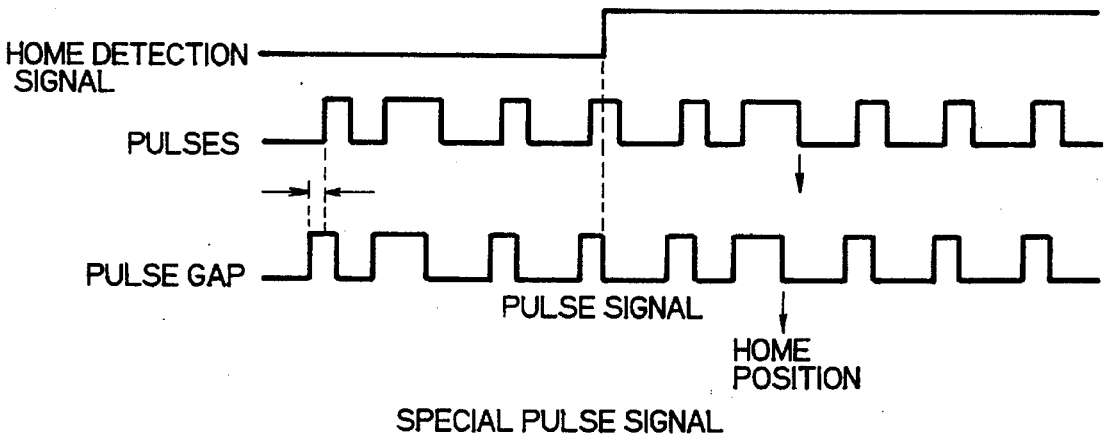
FIG. 14 is an operation timing chart of the small-sized printer of the fourth embodiment of the present invention.

A small-sized printer according to the fourth embodiment of the present invention will now be described with reference to FIG. 12 through 14. FIG. 12 is a schematic perspective view of the small-sized printer; FIG. 13 is a plan view of the encoder of FIG. 12; and FIG. 14 is an operation timing chart of the small-sized printer of FIG. 12.

Figure 16:
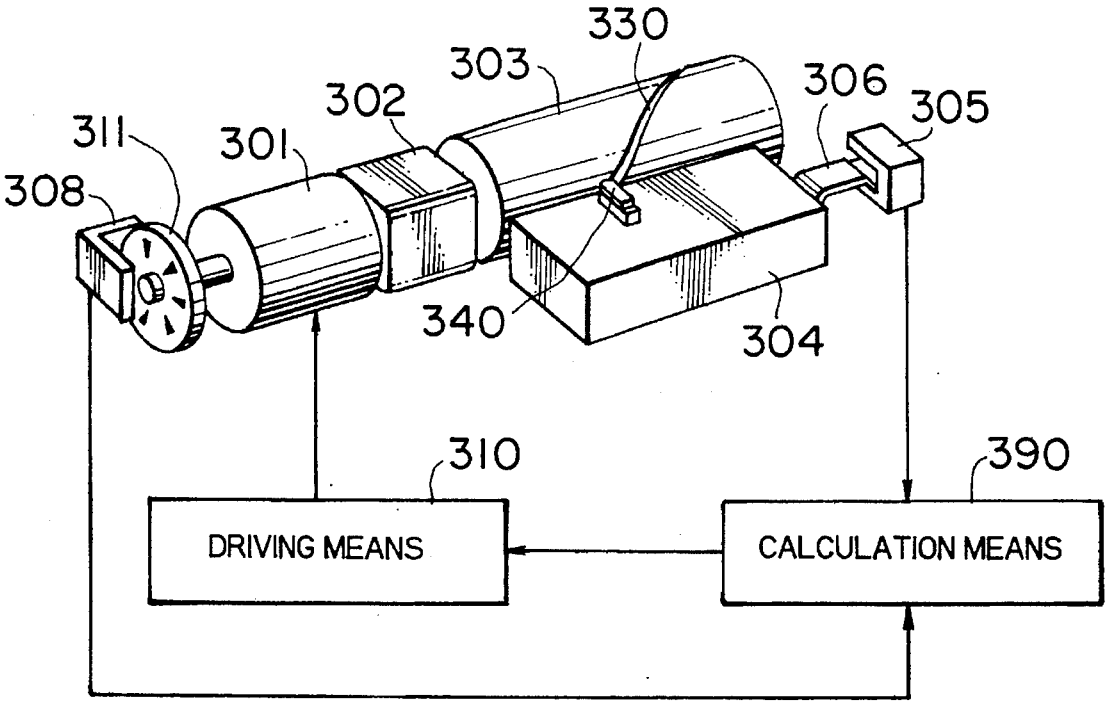
FIG. 16 PRIOR ART
FIG. 16 is a schematic view of a conventional small-sized printer.
Figure 17:
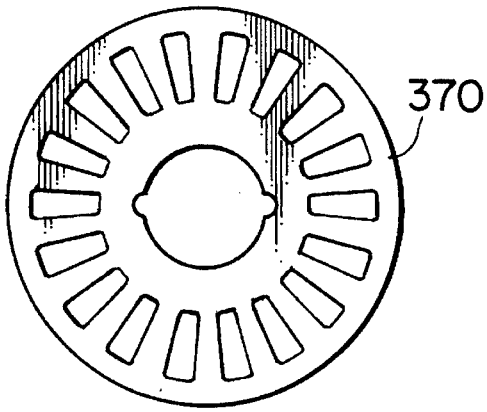
FIG. 17 PRIOR ART
FIG. 17 is a plan view of an encoder in a conventional small-sized printer.
Figure 18A:
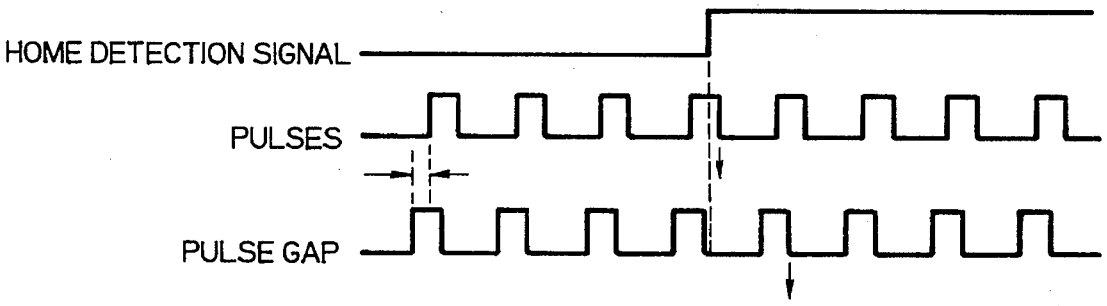
FIG. 18A PRIOR ART
FIG. 18A is an operation timing chart of a prior-art example.
Figure 18B:
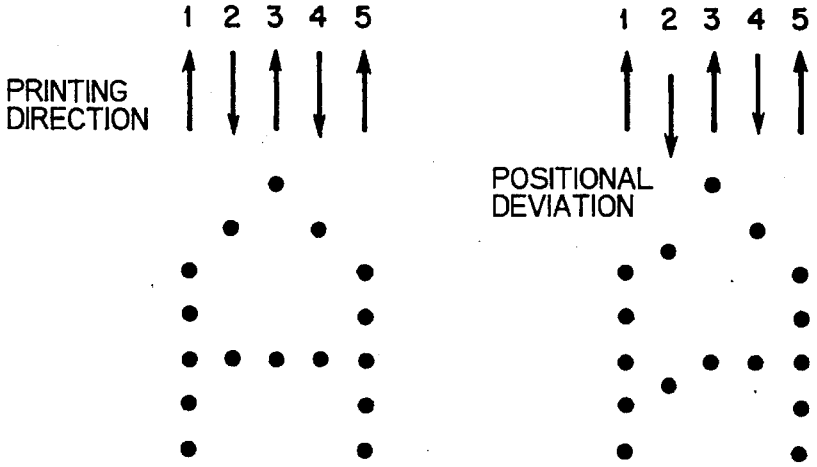
FIG. 18B PRIOR ART
FIG. 18B is a diagram showing how a printing deviation occurs in a prior-art example.

Referring to the above drawings, the small-sized printer of this embodiment comprises, in common with the prior-art example of FIG. 16, the motor 301, the gear box 302, the cylindrical cam 303, the printing head 304, the home detecting means 305, the shutter 306, and the driving means 310. In addition to the above components, the small-sized printer of this embodiment is provided with a special encoder 307 and a calculation means 309.

As shown in FIG. 13, the encoder 307 comprises a disc having a plurality of ordinary slits 371 formed concentrically and arranged in groups each consisting of three slits arranged at equal intervals and special slits 372 formed between the groups of the ordinary slits 371 and having a width smaller than that of the latter. Ordinary pulse signals corresponding to the rectangular wave signals are generated by the shielding sections between the ordinary slits 371, and a special pulse signal corresponding to the home detection rectangular wave signal is generated by the shielding section between each special slit 372 and the adjacent ordinary slit 371.

The calculation means 309 obtains the logical sum condition for the "H" level of the home detection signals output from the home detecting means 305 and the "H" level of the ordinary pulse signals (or the special pulse signals), and, on the basis of a special pulse signal input after the logical sum condition has been obtained, the home position is detected.

The operation of this printer, constructed as described above, will now be explained. The cylindrical cam 303 is rotated by the motor 301 through the gear 302. The printing head 304 has a protrusion engaged with the guide groove 330 of the cylindrical cam 303 and moves to the right and left to perform printing. When the printing head 304 has been moved to the home position, the shutter 306 attached to the printing head 304 intercepts the home detecting means 305 having a transmission-type optical sensor, thereby generating a home detection signal. The pulse generating means 308 generates a row of pulses at fixed intervals in synchronism with the rotation of the motor 301, to which the encoder 307 is attached, and the calculation means 309 performs calculation on the home detection signal and the pulse signals, whereby the home position of the printing head 304 is determined. Then, printing is started from the home position while counting the pulses generated.

Figure 15:
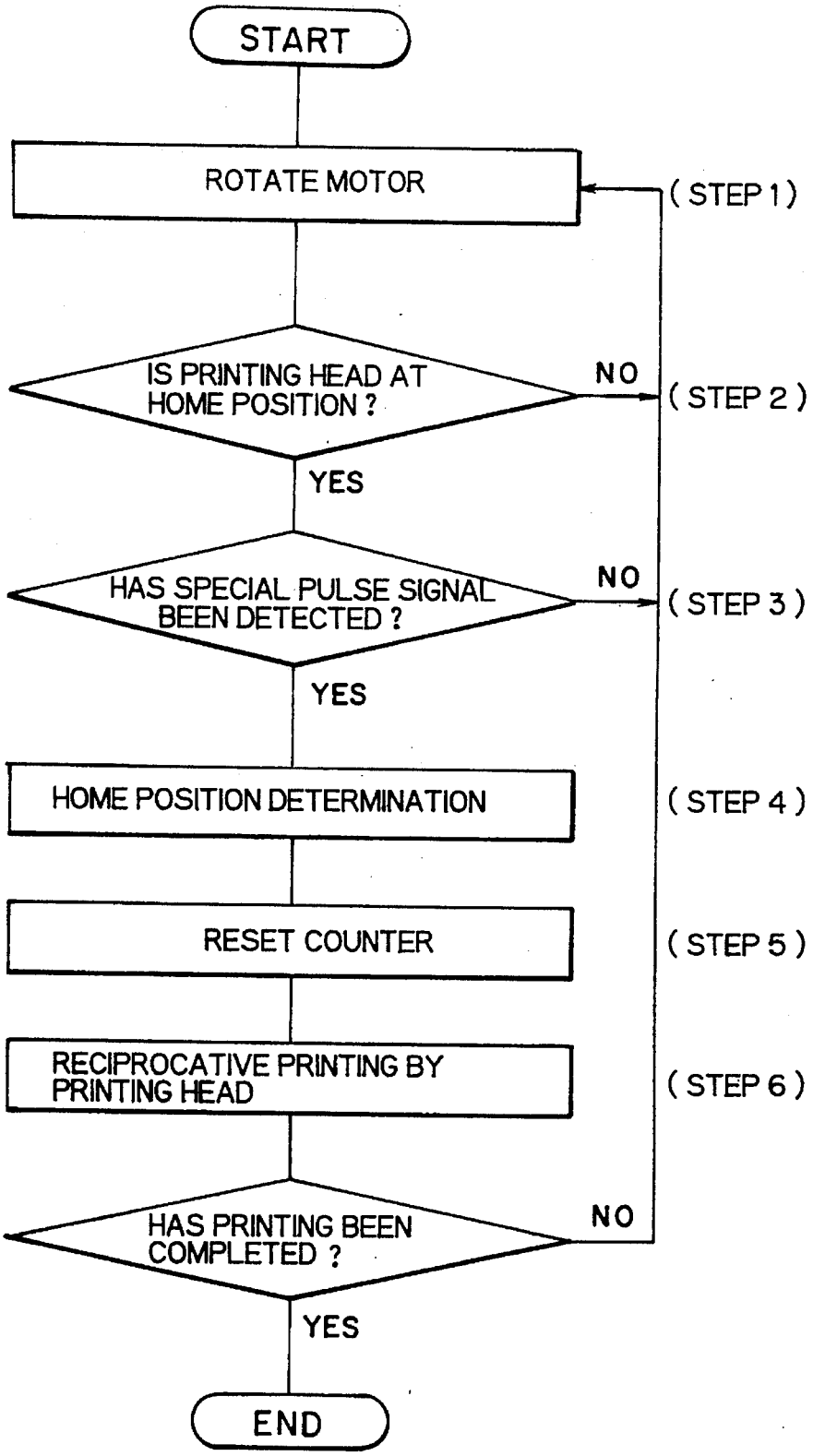
FIG. 15 is a flowchart of the printing operation of the small-sized printer of the fourth embodiment of the present invention.

Next, the printing operation will be described with reference to the flowchart of FIG. 15. First, the motor 301 is rotated to move the printing head 304 to the home position (step 1). Then, judgment is made as to whether the printing head 304 has been moved to the home position or not (step 2). When the printing head is judged not to have been moved to the home position yet, the motor 301 is driven to move the printing head 304 until a home detection signal is detected. When the printing head is judged to have been moved to the home position, the motor 301 is rotated until a special pulse signal, which is a relatively long special pulse, is detected from among the pulses generated from the pulse detecting means 308 (step 3). When the special pulse signal has been detected, the calculation means 309 concludes the position where fall of the home detection signal and the special pulse signal occurs to be the home position of the printing head (step 4). Then, a built-in counter (not shown) provided in the calculation means 309 is reset (step 5), and the printing head 304 is driven while counting the pulses from the pulse generating means 308, thereby performing reciprocative printing (step 6). After the completion of one cycle of reciprocative printing, the procedure returns to step 1, where the motor is driven to detect the home position again.

Due to the above operations, any discrepancy between the home detection signal and the pulse signals is acceptable as long as it occurs between special pulse signals since, as shown in FIG. 14, the home position corresponds to the falling of the next special pulse signal, thus preventing this discrepancy from causing a pulse gap corresponding to one pulse as in the conventional printer described above. Thus, it is always possible to start printing at a position spaced apart from the home position by a fixed distance, thereby ensuring the requisite stability in registration for two-direction printing.

While the above embodiment has been described with reference to the case where the initial position detecting device is applied to a small-sized printer, it is also applicable to various types of apparatuses which are driven on the basis of an initial position serving as an operational reference.

As described above, in accordance with the fourth embodiment of the present invention, starting point signals are output from a starting point output means, and detection rectangular wave signals inserted at equal intervals between the rectangular wave signals of a pulse row are output from a rectangular wave signal output means. The logical sum condition for these starting point signals and the rectangular wave signals is obtained, and, on the basis of the detection rectangular wave signals input after the logical condition has been satisfied, the initial position detecting means detects the initial position, so that deviation of the logical condition due to an output error of the rectangular signals can be prevented, thereby making it possible to correctly detect the initial position.

Further, in accordance with the present invention, the detection of the initial position is correctly effected, and the printing means is moved on the basis of the initial position thus detected, thereby ensuring the requisite accuracy in registration for the printing means in two-way printing.

What is claimed is:

1. A printer which is adapted to perform printing on a printing medium having first and second side directions, said printer comprising:

medium feeding means for feeding the printing medium in a main scanning direction which is adapted to be parallel to the first side direction of the printing medium;

printing means comprising a plurality of printing units disposed in parallel in a sub-scanning direction which is adapted to be parallel to the second side direction of the printing medium;

printing drive means for reciprocally moving the printing means in the sub-scanning direction;

a counterweight; and counterweight moving means for reciprocally moving the counterweight with a phase opposite to a phase of reciprocal movement of the printing means, said counterweight moving means being disposed between said printing means and said counterweight and comprising a cylindrical cam for engaging with both said printing means and said counterweight and for rotating about an axis parallel to the sub-scanning direction.

2. A printer according to claim 1, wherein said printing medium is a check for use in banking.

3. A printer according to claim 1, wherein each of the plurality of printing units comprises an impact-type printing unit.

4. A printer according to claim 1, further comprising a body case for receiving the medium feeding means, the printing means and the printing drive means, the body case having a longer side disposed in the main scanning direction and a shorter side disposed in the sub-scanning direction.

5. A printer according to claim 1, wherein the plurality of printing units are spaced apart from one another.

6. A printer which is adapted to perform printing on a printing medium having first and second side directions, said small-sized printer comprising:

a body case having a first side disposed in a main scanning direction and a second side disposed in a sub-scanning direction, the body case being adapted to receive the printing medium so that the first side direction of the printing medium is parallel to the main scanning direction of the body case and so that the second side direction of the printing medium is parallel to the sub-scanning direction of the body case;

a case cover openably and closably mounted on said body case;

medium feeding means, received in said body case, for feeding the printing medium in the main scanning direction;

printing means, received in said body case, comprising a plurality of printing units disposed in parallel in the sub-scanning direction;

printing drive means, received in said body case, for reciprocally moving the printing means in the sub-scanning direction;

a counterweight;

counterweight moving means for reciprocally moving the counterweight with a phase opposite to a phase of reciprocal movement of the printing means, said counterweight moving means being disposed between said printing means and said counterweight and comprising a cylindrical cam for engaging with both said printing means and said counterweight and for rotating about an axis parallel to the sub-scanning direction; and a plurality of protruding members which are disposed on the case cover and which prevent movement of the printing medium in a direction opposite to the main scanning direction so as to store the printing medium.

7. A printer according to claim 6, wherein said protruding members have a substantially L-shaped cross-sectional configuration so as to hold side edge portions of the printing medium.

8. A printer according to claim 6, wherein said medium feeding means has feeding rollers exposed on a side opposed to said case cover, and wherein said case cover has printing medium supporting members provided at positions which are opposed to said feeding rollers when said case cover is closed on said case body.

9. A printer according to claim 8, wherein said printing medium supporting members comprise springs for pressing the printing medium against said feeding rollers.

10. A printer according to claim 6, wherein said printing medium is a check for use in banking.

11. A printer according to claim 6, wherein each of the plurality of printing units comprises an impact-type printing unit.

12. A printer according to claim 6, wherein the first side of the body case is longer than the second side of the body case.

13. A printer according to claim 6, wherein the plurality of protruding members are disposed on a surface of the case cover which is opposed to the body case when the case cover is closed, and the plurality of protruding members guide the printing medium as the medium feeding means feeds the printing medium.

14. A printer according to claim 6, wherein the plurality of printing units are spaced apart from one another.

15. A printer which is adapted to perform printing on a printing medium having first and second side directions, said printer comprising:

a body case having a first side disposed in a main scanning direction and a second side disposed in a sub-scanning direction, the body case being adapted to receive the printing medium so that the first side direction of the printing medium is parallel to the main scanning direction of the body case and so that the second side direction of the printing medium is parallel to the sub-scanning direction of the body case;

a case cover openably and closably mounted on said body case and having an opposing surface which is opposed to the body case when the case cover is closed;

medium feeding means, received in said body case, for feeding the printing medium in the main scanning direction;

printing means, received in said body case, comprising a plurality of printing units disposed in parallel in the sub-scanning direction;

printing drive means, received in said body case, for reciprocally moving the printing means in the sub-scanning direction;

a counterweight;

counterweight moving means for reciprocally moving the counterweight with a phase opposite to a phase of reciprocal movement of the printing means, said counterweight moving means being disposed between said printing means and said counterweight and comprising a cylindrical cam for engaging with both said printing means and said counterweight and for rotating about an axis parallel to the sub-scanning direction;

a flat platen provided on the opposing surface of said case cover; and a plurality of protruding members which are disposed on the case cover and which prevent movement of the printing medium in a direction opposite to the main scanning direction so as to store the printing medium.

16. A printer according to claim 15, wherein said flat platen comprises a damping steel plate.

17. A printer according to claim 15, wherein said medium feeding means includes printing protrusions for contacting said flat platen when said case cover is closed on said body case, and wherein said case cover has a biasing means for pressing said flat platen against said printing protrusions, and a free space following said flat platen to retreat against a resilient force of said biasing means.

18. A printer according to claim 15, further comprising an ink ribbon provided between said printing means and said flat platen and detachably engaged with said printing means.

19. A printer according to claim 15, wherein said protruding members have a substantially L-shaped cross-sectional configuration so as to hold side edge portions of the printing medium.

20. A printer according to claim 15, wherein said medium feeding means has feeding rollers exposed on a side opposed to said case cover, and wherein said case cover has printing medium supporting members provided at positions which are opposed to said feeding rollers when said case cover is closed on said case body.

21. A printer according to claim 20, wherein said printing medium supporting members comprise springs for pressing the printing medium against said feeding rollers.

22. A printer according to claim 15, wherein said printing medium is a check for use in banking.

23. A printer according to claim 15, wherein each of the plurality of printing units comprises an impact-type printing unit.

24. A printer according to claim 15, wherein the plurality of protruding members are disposed on the opposing surface of the case cover and guide the printing medium as the medium feeding means feeds the printing medium.

25. A printer according to claim 15, wherein the first side of the body case is longer than the second side of the body case.

26. A printer according to claim 15, wherein the plurality of printing units are spaced apart from one another.

* * * * *